United States Patent [19]

Henstra et al.

[11] 4,165,261

[45] Aug. 21, 1979

[54] APPARATUS FOR CLEANING A COKE OVEN DOOR

[75] Inventors: Rauke Henstra; Tonny van der Kley, both of Heerhugowaard; Johannes N. M. Rens, Velsen-Noord, all of Netherlands

[73] Assignee: Hoogovens Ijmuiden, B.V., Ijmuiden, Netherlands

[21] Appl. No.: 827,076

[22] Filed: Aug. 23, 1977

[30] Foreign Application Priority Data

Aug. 23, 1976 [NL] Netherlands ..... 7609329

[51] Int. Cl.[2] ..... C10B 43/08

[52] U.S. Cl. ..... 202/241; 15/93 A; 134/172

[58] Field of Search ..... 202/241; 134/172–174, 134/180, 181, 198, 199; 15/93 A

[56] References Cited

U.S. PATENT DOCUMENTS

| | | | |
|---|---|---|---|
| 3,454,426 | 7/1969 | Taylor | 202/241 X |
| 3,559,659 | 2/1971 | Gougoulas | 134/181 X |
| 3,847,753 | 11/1974 | Baird et al. | 202/241 |
| 3,892,250 | 7/1975 | Miko | 202/241 X |

*Primary Examiner*—Morris O. Wolk

*Assistant Examiner*—Arnold Turk

*Attorney, Agent, or Firm*—Stevens, Davis, Miller & Mosher

[57] ABSTRACT

Apparatus for cleaning a coke oven door, which has upper and lower closing surfaces and two side closing surfaces which are to be cleaned, the cleaning apparatus being relatively positionable in a position for cleaning when the door is open, comprising a mobile frame having positioning surfaces engageable with guide surfaces at the said upper, lower and two side surfaces of the door in order to locate the door and apparatus in the cleaning position, the frame including horizontally extending upper and lower guide elements and at least one vertically extending guide element, carriages movable along the guide elements, fluid jets carried by said carriages directed (in the cleaning position) at the closing surfaces, at least one jet on the carriage which moves along the vertically extending guide element being connected by at least one resilient element to that carriage and there being at least one follower member connected to the jet which in use engages and is pressed by the resilient element against a guide strip on the door so as to maintain the jet in a cleaning position relative to the vertical closing surfaces being cleaned by that jet.

6 Claims, 7 Drawing Figures

APPARATUS FOR CLEANING A COKE OVEN DOOR

The invention relates to apparatus for cleaning a coke over door in the open position of the door.

German Patent Specification No. 2 143 595 discloses apparatus for cleaning a coke oven door in which the door in its non-operative position is placed inside a hood which is connected to a ventilation system. Inside the hood are positioned a large number of stationary high-pressure fluid jets which are directed towards the closing rims of the coke oven door. The surfaces of these rims, by which the coke oven door closes against a frame in a coking chamber, are cleaned of deposits of tar, coal and other dirt by water directed against them at a pressure of about 200 atmospheres.

U.S.A. Patent Specification No. 3,892,250, also describes an apparatus for cleaning a coke oven door in which the door in the open position is cleaned by means of high-pressure fluid jets, and which has improved performance compared with the apparatus of German Specification No. 2 143 595. This improvement is obtained by a smaller number of fluid jets oriented in various directions towards the closing rims of the coke oven door. These jets are moved parallel to the rims. The aim is to obtain a more uniform and even cleaning of the doors. In this apparatus, the fluid jets are moved by means of a chain along a guide rail which encompasses the closing rims of the coke oven door when the latter is placed in the cleaning apparatus.

In order to obtain adequate cleaning, it has now been found that it is necessary for the high-pressure jets to be positioned very carefully with respect to the closing rims of the door. Very exact positioning of cleaning apparatus relative to the door and an extremely stably constructed guiding system should be obtained. In practice coke oven doors may suffer slight deformations. In cleaning, the path of the fluid jets should be adaptable to these deformations and also to small variations due to tolerances in the dimensions of the doors.

According to the invention there is provided apparatus for cleaning a coke oven door, in combination with at least one coke oven door which has upper and lower closing surfaces and two side closing surfaces which are to be cleaned, the cleaning apparatus and door being relatively positionable in a position for cleaning when the door is open. The cleaning apparatus comprises a mobile frame having positioning surfaces engageable with guide surfaces at the said upper, lower and two side surfaces of the door in order to locate the door and apparatus in the cleaning position, the frame providing horizontally extending upper and lower guide elements and at least one vertically extending guide element corresponding to the closing surfaces of the door. The apparatus includes respective carriages movable along said guide elements and carrying fluid jets directed (in the cleaning position) at said closing surfaces. A jet or jets on the carriage which moves along the vertically extending guide element is connected by at least one resilient element to that carriage and there is at least one follower member connected to the jet or jets which in use engages and is pressed by the said resilient element against a guide track on the door so as to maintain the jet or jets in a desired relation to the vertical closing surface or surfaces being cleaned by that jet or jets.

As the mobile frame of the cleaning apparatus is directly located with respect to the guide surfaces on the coke oven door, the guide elements, e.g. rails, can be positioned with a high degree of accuracy with respect to the closing rims of the door. The guide surfaces on the door may be projections. Further adaptation of the position of the vertically movable jets relative to the vertical closing rims can be obtained because these jets are resiliently connected to the carriage which moves on a vertical guide element. The guiding of the vertically movable jets, e.g. by rollers along guide strips attached to the door, can cause the jets to remain very accurately directed towards the closing rims from one place to another.

It has been found that the positioning of the horizontally movable jets in relation to the relatively short upper and lower closing rims of the door may cause a less serious problem than the correct positioning of the vertically movable jets. It may therefore not be necessary to have these horizontally movable jets supported resiliently against horizontal guide tracks. It was also found possible, because of the short stroke which these jets need to preform, to actuate the carriages which move along the horizontal guide tracks by means of piston and cylinder units. Because of the long stroke required of the vertically moving jets, it has been found preferable that the carriage which moves along the vertical guide track should be connected to a cable or other rope which is actuated by means of a variable speed motor, preferably via a drum.

Although it is conceivable to provide carriages with jets moving along separate vertical guide tracks for both vertical closing rims of the door, for simplicity of construction it has been found preferable to have a single vertical guide track. Thus the vertically movable carriage is preferably fork-shaped as seen in plan, having two legs which respectively extend in use to the two vertical sides of the door, the jet or jets at each side being hingedly connected to the carriage and the said resilient element at each side urging the jet or jets inwardly towards the door about the hinge.

To obtain an accurate positioning of the door with respect to the jets, it is preferred that the horizontally extending and vertically extending guide elements are independently resiliently mounted on the mobile frame, said positioning surfaces being rigid with the respective guide elements. This enables for small deformations or deviations in the dimensions of the door, as well as inaccurate positioning of the door, to be corrected.

An embodiment of the invention will now be described by way of example with reference to the accompanying drawings, in which:

FIG. 5 is a partial view in the direction of arrows V in FIG. 4;

Figure 1:
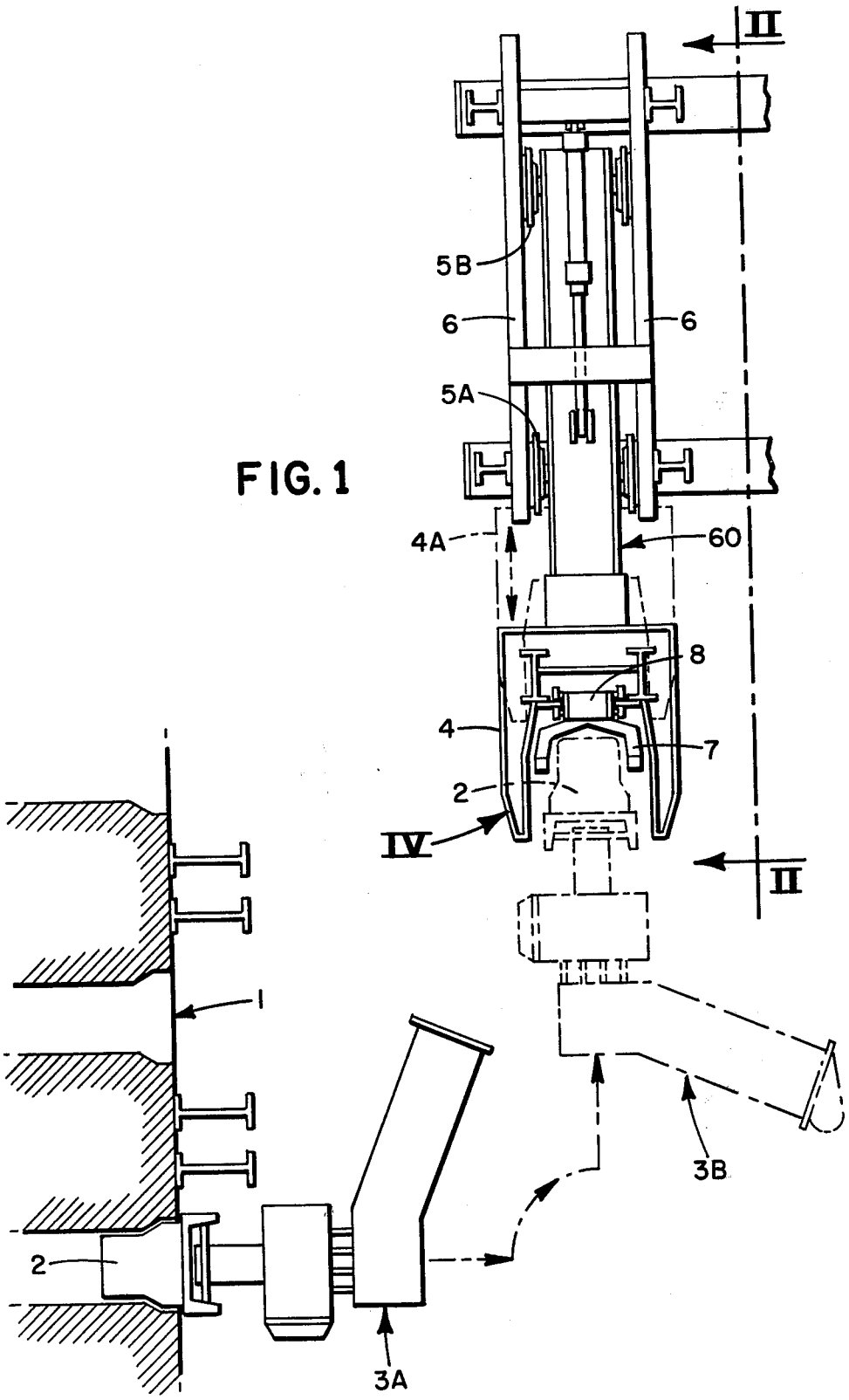
FIG. 1 shows the arrangement of the cleaning apparatus and door seen from above both the open and shut positions of the door being illustrated.

FIG. 1 shows part of a battery 1 of coking chambers in which one chamber is closed by coke oven door 2. This door 2 is shown in position 3A being secured to a door extractor machine, and is shown in phantom lines in position 3B being swung away by the machine and positioned opposite the door cleaning apparatus. A pair of forks 4 (see FIG. 2) which are part of a mobile frame 60 of this cleaning apparatus, may be moved between an extended position 4 and a withdrawn position 4A by rolling of the frame along horizontal rails 6 by means of wheels 5A and 5B. Rails 6 are fixed to a carriage (not shown) which can move along in front of the doors of the coking battery. Inside the forks 4 is seen a second fork 7 which carries jets 35, 36 (FIG. 4) at the end of its legs and which is movable vertically with respect to the mobile support frame 60 of the apparatus as it is mounted on a carriage 8. The two forks 4 are mounted on the cleaning apparatus at different heights for reasons which will be explained later.

Figure 2:
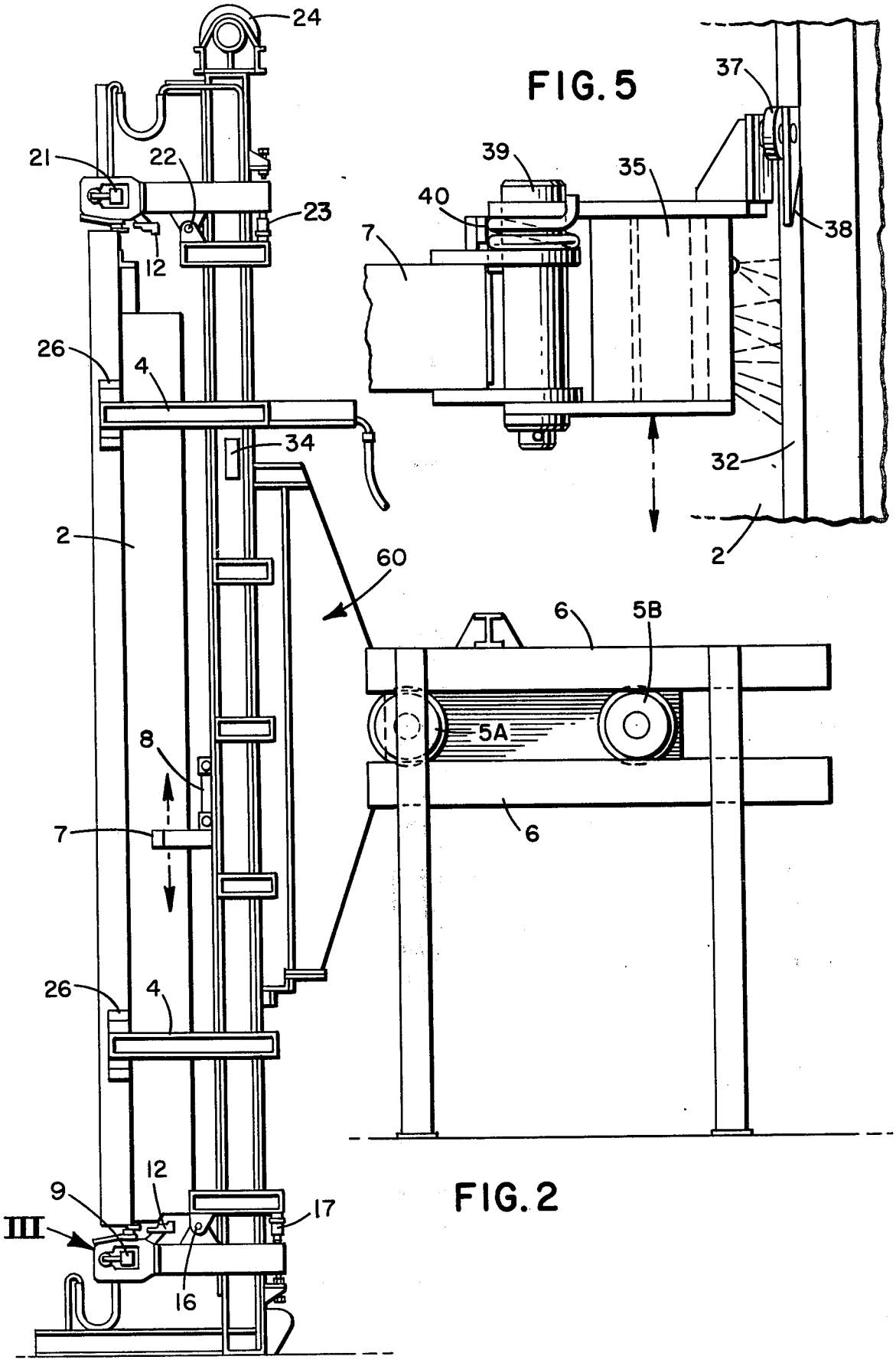
FIG. 2 is a partial view in the directions of arrows II of FIG. 1.

The carriage 8 is movable vertically, so that its legs 7, having the jets at their ends, are moved along the rims of door 2. The carriage 8 is itself connected to a cable (not shown) which may be driven by means of a variable speed motor via the schematically shown cable drum 24 (FIG. 2). The cable is led around guide wheels (not shown) near the lower end of the apparatus.

Figure 4:
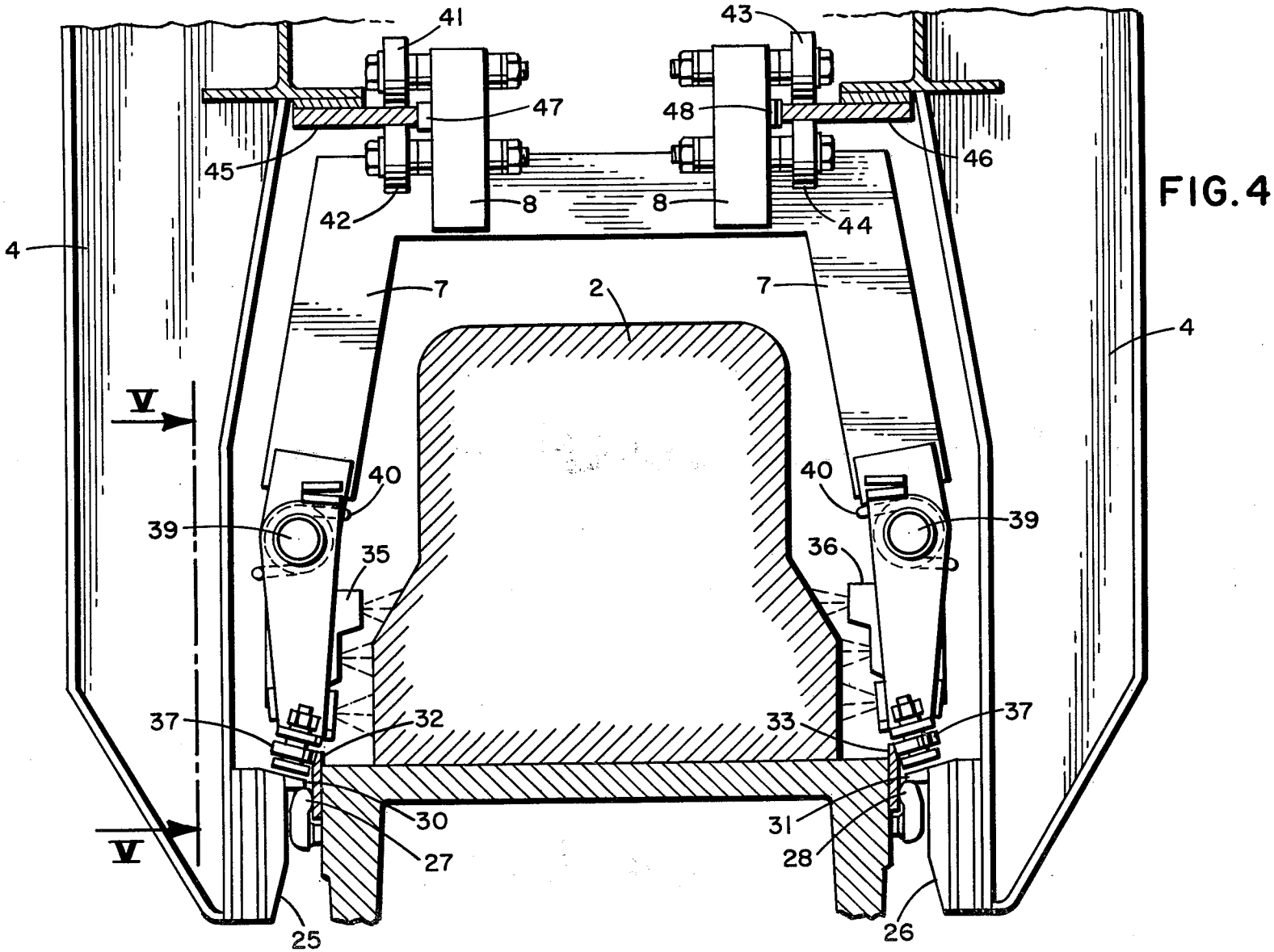
FIG. 4 shows the detail indicated by arrow IV in FIG. 1, on an enlarged scale.

FIG. 4 shows that the carriage 8 is provided with wheels 41 to 44 and 47 and 48 by which it may accurately move along guide rails 45 and 46, which are fixed to the forks 4. At the end of the legs of fork 4 there are cam or locating surfaces 25 and 26 which cooperate with projecting elements 27 and 28 on the sides of the door 2 until these elements 27 and 28 contact projections 30 and 31 on the fork 4. In order to permit the lateral movement of the fork 4 during the locating process, these forks 4 are resiliently connected to the frame of the apparatus which is movable on wheels 5*a* and 5*b*. This resilient mounting is generally indicated by reference number 34 in FIG. 2, which also shows the cam surface 26. As the whole carriage 8 and the fork 7 connected thereto move transversely together with the forks 4, the jets 35, 36 on the fork 7 are correctly located when the forks 4 are positioned opposite the door 2. In order nevertheless to obtain further positioning of these jets 35 and 36, they are movably connected to the fork 7 by means of hinge pins 39. Coil springs 40 surrounding hinge pins 39 urge rollers 37 into contact with guide strips 32, 33. By means of guide wheels 37, which rest against guide strips 32 and 33 on the door and are mounted with the jets to pivot around the pins 39, highly accurate positioning of the jets 35, 36 with respect to the door 2 can be obtained.

FIG. 5 shows that the jet assemblies 35, 36 each produce a plurality of streams, one of these streams being directed against the guide strips 32 and 33 respectively so as to clean them before the rollers 37 run onto them.

When the door 2 is removed from the cleaning apparatus, the carriage 8 is first moved into its extreme lower position, in which a cam surface 38 (see FIG. 5) moves against a projection (not shown) which keeps the resilient ends of the fork 7 outwardly extended. When another door is located in the apparatus, the roller 37 again comes in contact with the guide strip 32 of the door in the desired way, upon upward movement of the carriage 8.

Figure 3:
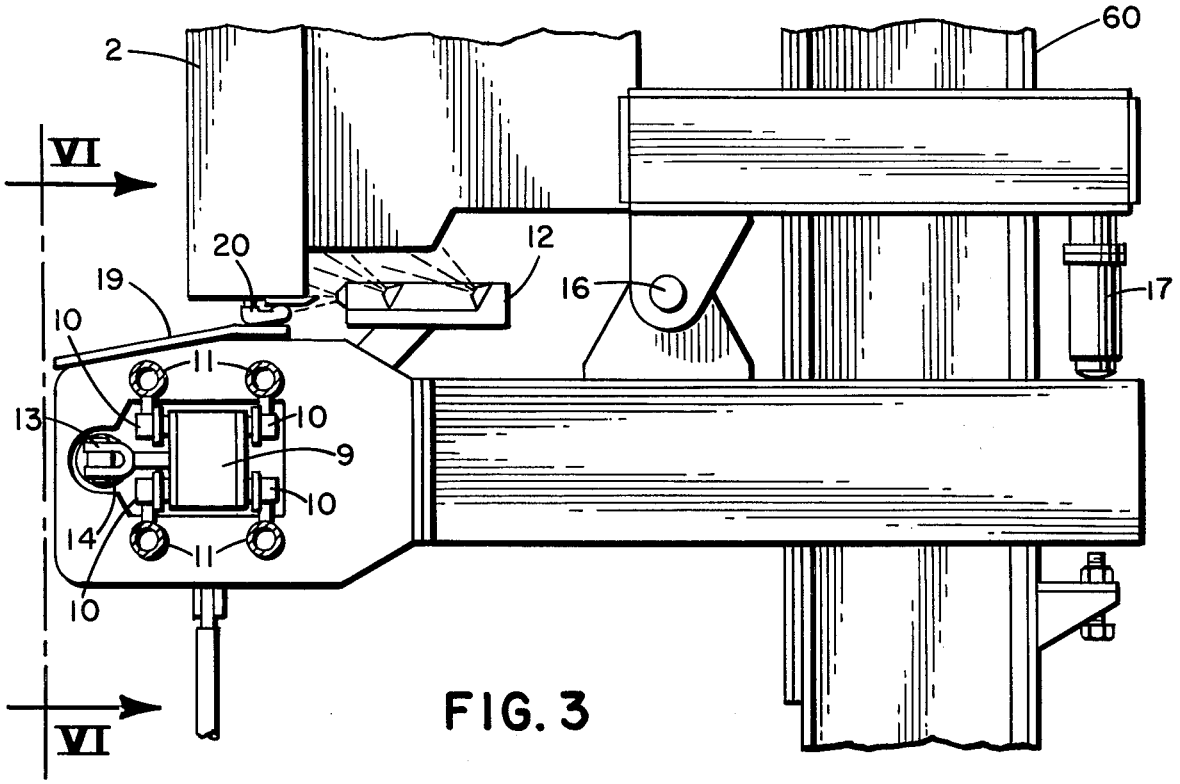
FIG. 3 shows the detail indicated by arrow III in FIG. 2, on an enlarged scale.
Figure 6:
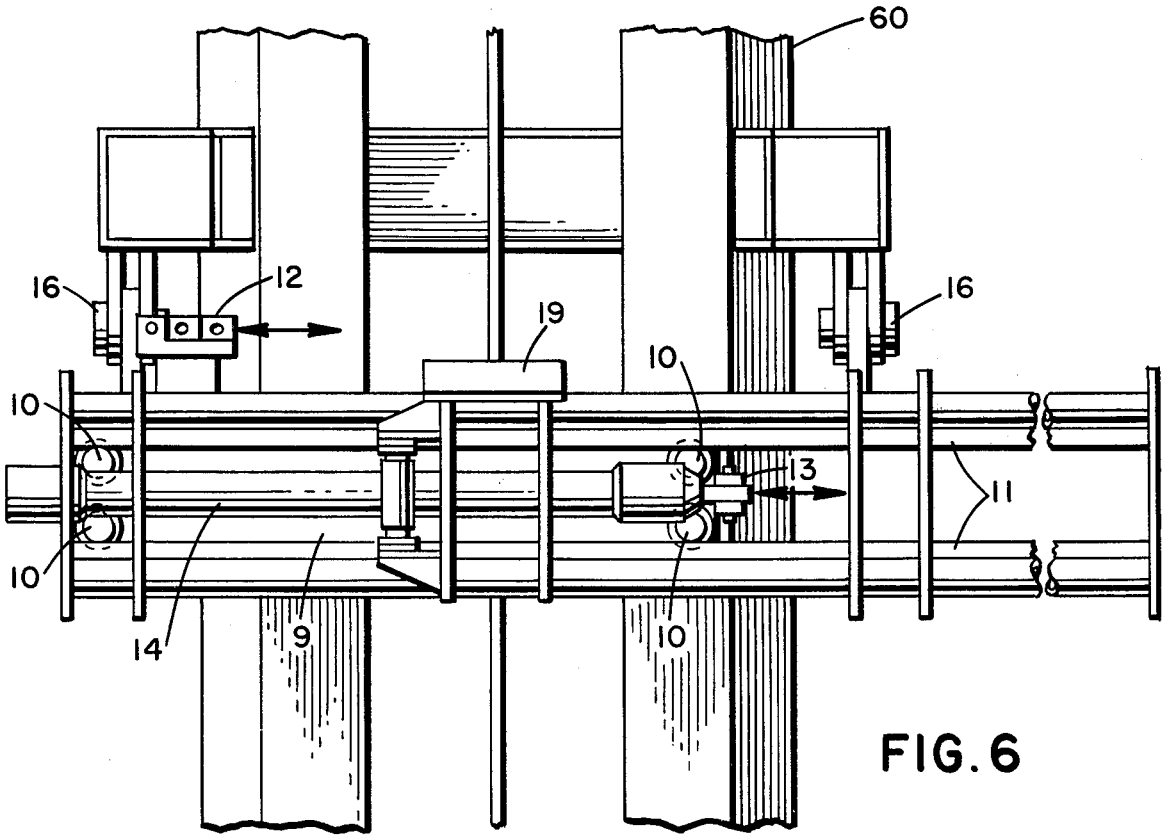
FIG. 6 is a side view in the direction of arrows VI in FIG. 3.

At the lower side of the apparatus at detail III in FIG. 2 and in FIGS. 3 and 6, a horizontally movable jet 12 is carried by a carrige 9 which is movable inside four guide rails 11 on wheels 10. The carriage 9 is moved by a hydraulic piston and cylinder unit 14 via a coupling arm 13. Guide rails 11 are constructed to have sufficient length to enable the carriage 9 with the jet 12 to be driven along the entire length of door 2 in order that upon location and removal of the door 2 difficulties are not experienced. The guide rail 11 carries a running-on surface 19 which cooperates with an element 20 at the lower side of the door. Accurate positioning of the jet 12 is thus obtained because the guide rail 11 can swing around a hinge 16 against the force exerted by a resilient element 17.

At the upper side of the apparatus, a guide rail 21 together with carriage and jet are provided in symmetry with the guide rail 11 but otherwise in a similar manner. The hinge 22 and resilient element 23 seen in FIG. 2 have functions comparable to those of elements 16 and 17.

Figure 7:
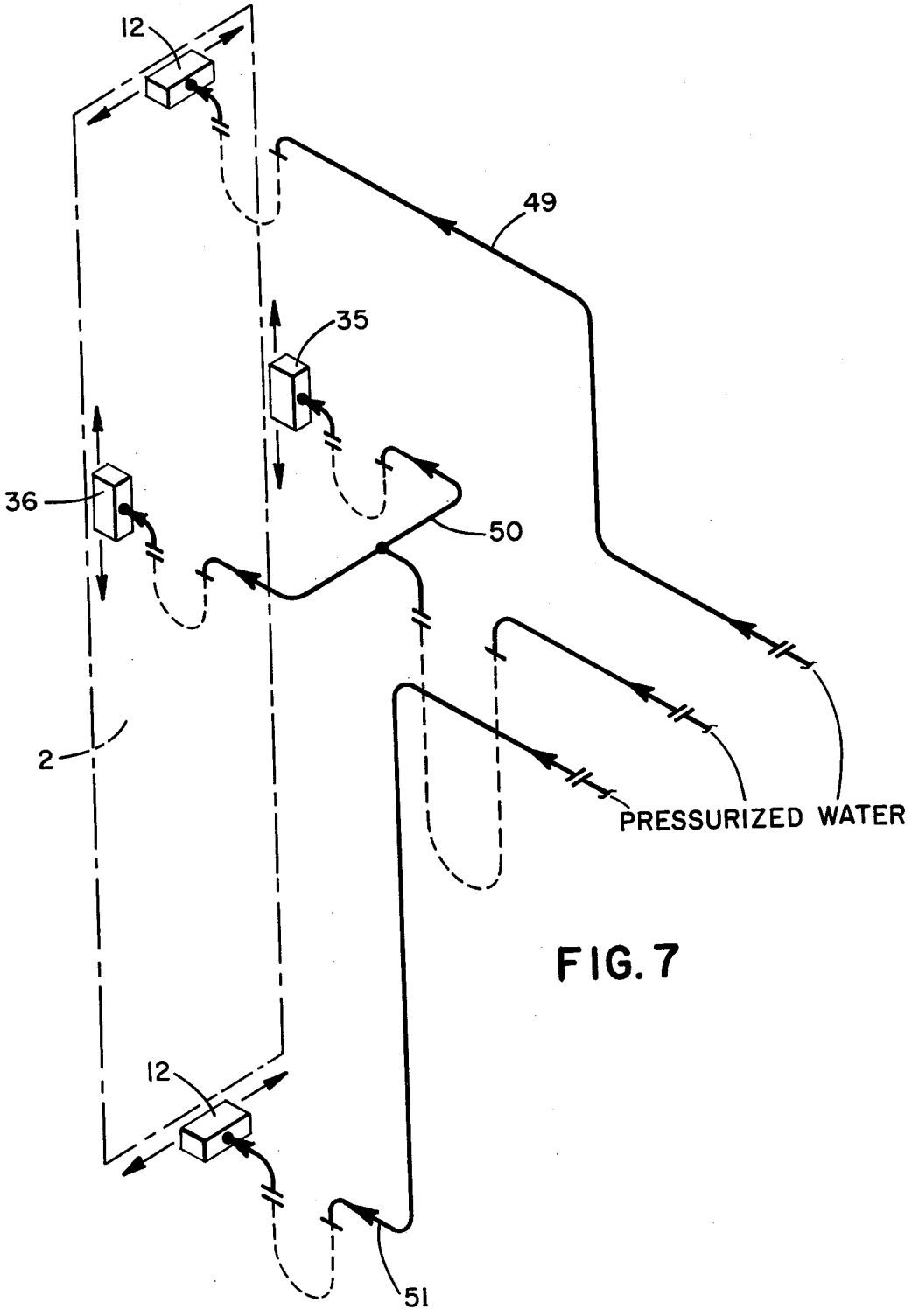
FIG. 7 is a schematic diagram showing the fluid supply and the movement of the jets.

In FIG. 7 it can be seen that the various jets 35, 36 and 12 are connected to a feed system for high-pressure water by means of high-pressure conduits 49, 50 and 51. Free hanging loops in these conduits enable the movement of the jets along their paths. The water is supplied to the various jets at a pressure of between 500 and 700 atmospheres.

What we claim is:

1. Apparatus for cleaning a coke oven door, which has upper and lower closing surfaces and two side closing surfaces which are to be cleaned, the cleaning apparatus being relatively positionable in a position for cleaning when the door is open, comprising a mobile frame having positioning surfaces engageable with guide surfaces at the said upper, lower and two side surfaces of the door in order to locate the door and apparatus in the cleaning position, said frame including horizontally extending upper and lower guide elements and at least one vertically extending guide element, carriages movable along said guide elements, fluid jets adapted to spray high pressure water carried by said carriages directed in the cleaning position at said closing surfaces, at least two jets on the carriage which moves along the vertically extending guide element being connected by resilient elements to that carriage and there being at least one follower member connected to each jet which in use engages and is pressed by the said resilient element against a guide strip on said door so as to maintain each jet in a cleaning position relative to the side closing surfaces being cleaned by each jet.

2. The apparatus according to claim 1 wherein the said follower member is a roller.

3. The apparatus according to claim 1 wherein the respective carriages movable along the upper and lower horizontally extending guide elements are moved in each case by a piston-cylinder unit.

4. The apparatus according to claim 1 wherein the carriage movable along the vertically extending guide element is moved by a variable speed motor by means of a rope.

5. The apparatus according to claim 1 wherein the vertically movable carriage is fork-shaped, having two legs which respectively extend in use to the two vertical sides of the door, and including at least one jet hingedly connected to each leg of the carriage and the said resilient element at each side urging said jet inwardly towards the door about the hinge.

6. The apparatus according to claim 5 wherein the horizontally extending and vertically extending guide elements are independently resiliently mounted on the mobile frame, said positioning surfaces being rigid with respect to the guide elements.

* * * * *